US005978977A

United States Patent [19]

Haydu et al.

[11] Patent Number: 5,978,977

[45] Date of Patent: Nov. 9, 1999

[54] SYSTEM FOR CONTROLLING THE TEMPERATURE OF A RAILING AND METHOD THEREFOR

[76] Inventors: Mary A. Haydu, 4354 N. 82nd St., Scottsdale, Ariz. 85251; Stanley S. Checinski, 1739 W. Banff La., Phoenix, Ariz. 85023

[21] Appl. No.: 09/021,051

[22] Filed: Feb. 9, 1998

[51] Int. Cl.[6] ..... E04H 4/00

[52] U.S. Cl. ..... 4/496

[58] Field of Search ..... 4/496, 507, 508

[56] References Cited

U.S. PATENT DOCUMENTS

| | | | |
|---|---|---|---|
| 3,090,489 | 5/1963 | Smith | 4/496 X |
| 3,139,628 | 7/1964 | Richards | 4/508 |
| 3,523,552 | 8/1970 | Ogden | 4/507 X |
| 4,193,143 | 3/1980 | De Carvalho Vianna | 4/496 X |

*Primary Examiner*—Charles E. Phillips

[57] ABSTRACT

A system for controlling the temperature of a railing. The system has a hollow railing having a first open end and a second open end. A conduit is coupled to the first open end of the hollow railing and is used for conveying a liquid to the hollow railing. The liquid travels through the hollow railing and is used to control the temperature of the hollow railing.

10 Claims, 4 Drawing Sheets

SYSTEM FOR CONTROLLING THE TEMPERATURE OF A RAILING AND METHOD THEREFOR

BACKGROUND OF THE INVENTION

1. Field of the Invention

This invention relates generally to railings, and more specifically, to a system for controlling the temperature of a railing in a pool or water spa.

2. Background of the Invention

Presently, many swimming pools and water spas (i.e., whirlpools, jacuzzi, hot tubs, etc.) have rails which are used to help individuals enter and exit the pools and spas. While the railings have many beneficial uses, they suffer from one main problem. In areas where the outside temperature is extremely warm (i.e., desert climates), the railings used in the pools and spas get extremely warm. In many desert areas, the railings may not be used during the summer months since the sunlight heats the railings to a temperature that is so hot, that individuals are unable to grab the railing for fear of getting burned.

Therefore, a need existed to provide a system for controlling the temperature of a railing. The system must be able to raise and lower the temperature of the railing to a temperature which is comfortable enough to allow an individual to grab hold of and use the railing. The system must also be able to be easily installed on existing swimming pools and water spas as well as those pools and spas yet to be built.

SUMMARY OF THE INVENTION

In accordance with one embodiment of the present invention, it is an object of the present invention to provide a system for controlling the temperature of a railing.

It is another object of the present invention to provide a system for controlling the temperature of a railing that is able to raise and lower the temperature of the railing to a temperature which is comfortable enough to allow an individual to grab hold of and use the railing.

It is still another object of the present invention to provide a system for controlling the temperature of a railing that is easy to install on existing swimming pools and water spas as well as those pools and spas yet to be built.

BRIEF DESCRIPTION OF THE PREFERRED EMBODIMENTS

In accordance with one embodiment of the present invention, a system for controlling the temperature of a railing is disclosed. The system has a hollow railing having a first open end and a second open end. A conduit is coupled to the first open end of the hollow railing and is used for conveying a liquid to the hollow railing. The liquid travels through the hollow railing and is used to control the temperature of the hollow railing.

In accordance with another embodiment of the present invention, a method of providing a system for controlling the temperature of a railing is disclosed. The method comprises the steps of: providing a hollow railing having a first open end and a second open end; and providing a conduit coupled to the first open end of the hollow railing for conveying a liquid to the hollow railing, the liquid traveling through and being used to control the temperature of the hollow railing.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENTS

Figure 1:
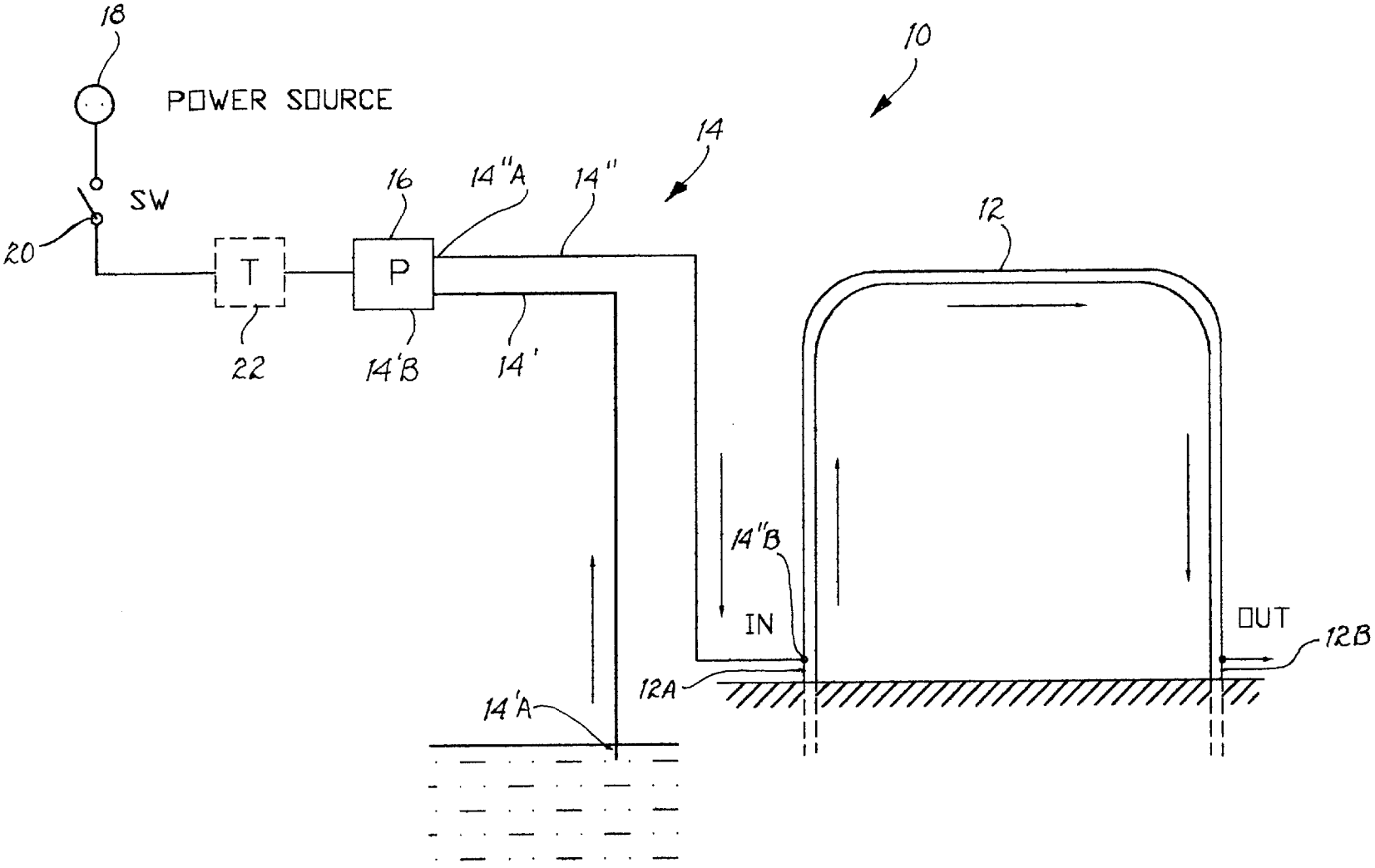
FIG. 1 is a simplified functional block diagram of a system for controlling the temperature of a railing.

Referring to FIG. 1, a system for controlling the temperature of a railing 10 (hereinafter system 10) is shown. The system 10 may be used to control the temperature of any type of railing. In the preferred embodiment of the present invention, the system 10 is used to control the temperature of an outside railing and, more specifically, the system 10 is used to control the temperature of an outside railing used to help individuals enter and exit a swimming pool/water spa (i.e., hot tub, jacuzzi, whirlpool, etc.).

The system 10 has a railing 12 which individuals use to enter and exit the pool/spa. The railing 12 is a hollow railing and has a first open end 12A and a second open end 12B. The railing 12 may be a preexisting railing 12 which was installed when the pool/spa was built, or the railing 12 may be a new railing 12 to be installed with a new pool/spa.

A conduit 14 is coupled to the first open end 12A of the railing 12. The conduit 14 is used for transferring a liquid to the railing 12. The liquid is forced to flow through the hollow railing 12 and is used to control the temperature of the hollow railing 12. In the preferred embodiment of the present invention, the liquid used to control the temperature of the railing 12 is the water located within the pool/spa where the railing 12 is installed.

In the preferred embodiment of the present invention, the second open end 12B of the hollow railing 12 is located within the pool/spa. Thus, once the water travels through the hollow railing 12, the water is returned to the pool/spa. However, it should be noted that the second open end may also be located outside the pool/spa and that a conduit may be used to return the water that travels through the hollow railing 12 back to the pool/spa. It should also be noted that the first open end 12A of the railing may be located inside or outside of the pool/spa.

In order to circulate the water through the conduit 14 and the railing 12, a small pump 16 may be used. In the preferred embodiment of the present invention, the pump 16 is a small horsepower AC pump. However, it should be noted that other types of pumps may be used.

The conduit 14 is generally broken into two sections. The first section 14' has a first open end 14'A which is placed within the pool/spa. The second open end 14'B of the first section 14' of the conduit 14 is coupled to an intake valve of the pump 16. A first open end 14"A of the second section 14" of the conduit 14 is coupled to an exit valve of the pump 16. The second open end 14"B of the second section 14" of the conduit 14 is coupled to the hollow railing 12. The first open end 14'A of the first section 14' of the conduit 14 should be placed at a sufficient level below the water line of the pool/spa to ensure that water will always be drawn into the conduit 14 and sent to the railing 12 when the pump 16 is activated.

When the pump 16 is activated, the pump 16 will draw water from the pool/spa into the intake valve via the first section 14' of the conduit 14. The water that is drawn into the pump 16 is then released through the exit valve of the pump 16. The water travels through the second section 14" of the conduit 14 and into the hollow railing 12. The circulating water will control the temperature of the hollow railing 12 to that of the circulating water.

In order to activate the pump 16, a power source is required. In the embodiment shown in FIG. 1, a power supply 18 is used for this purpose. In the preferred embodiment of the present invention, an AC power supply 18 is used. However, it should be noted that alternative power sources may be used (i.e., gasoline powered, solar power, etc.). A switch 20 may be positioned between the power supply 18 and the pump 16. The switch 20 is used to couple the power supply 18 to the pump 16. Thus, the switch 20 is used to activate or deactivate the pump 16 whenever an individual desires to circulate water through the railing 12. A timer 22 may also be coupled to the pump 16 in order to circulate the water through the hollow railing 12 at specific periods during the day.

Figure 2:
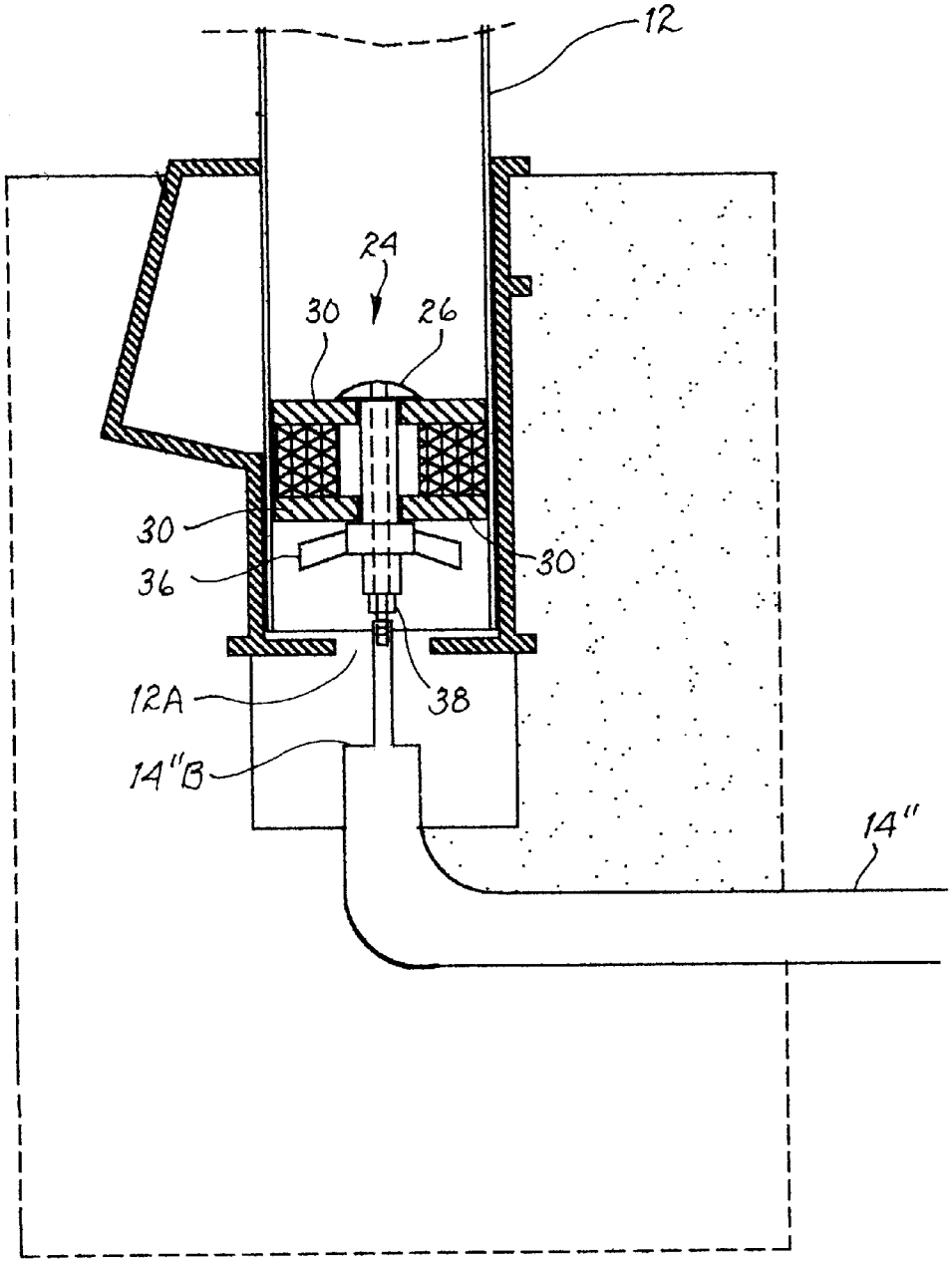
FIG. 2 is a cross-sectional front view of the plug/railing/conduit connection for the system depicted in FIG. 1.
Figure 3:
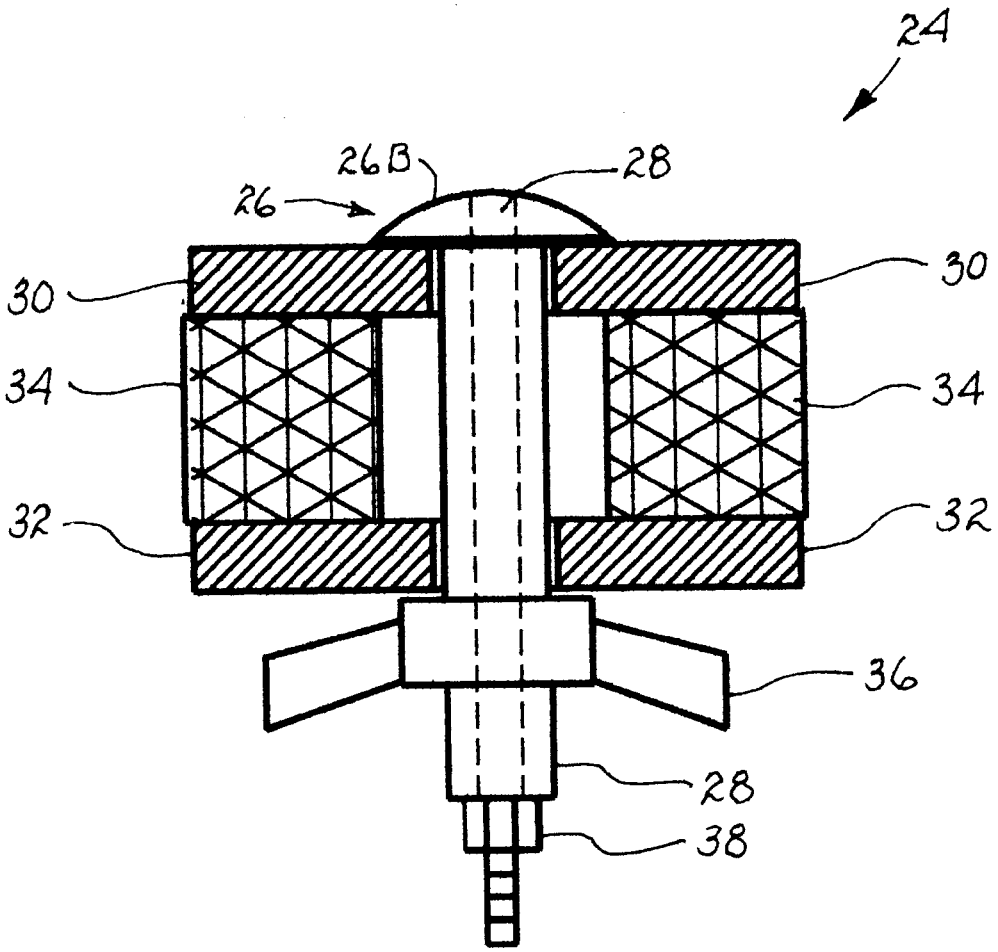
FIG. 3 is a front view of the plug used in the system depicted in FIG. 1.

Referring now to FIGS. 2–3 wherein like numerals and symbols represent like elements, a plug 24 is shown. The plug 24 is used to connect the conduit 14 to the hollow railing 12 and for forming a liquid tight seal in the hollow railing 12. As can be seen more clearly in FIG. 2, the plug 24 is located at the first opening 12A of the hollow railing 12. The plug 24 has an elongated bolt 26. The bolt 26 has a channel 28 drilled through the entire length of the bolt 26. The channel 28 is used to allow the water to pass from the conduit 14 into the hollow railing 12. The bolt 26 is placed through a central opening in a first washer 30 such that the first washer 30 is positioned against the flat edge of the head 26B of the bolt 26. The bolt 26 is also placed through a central opening in a second washer 32. Both the first washer 30 and the second washer 32 may be made out of any type of material. However, in order to ensure the longevity of the system 10, both the first washer 30 and the second washer 32 should be made out of a material that will not rust.

A gasket 34 is positioned in between the first washer 30 and the second washer 32. The gasket 34 is used for forming the liquid tight seal at the first open end 12A of the hollow railing 12. The water tight seal which is formed at the first open end 12A of the hollow railing 12 will prevent the water from flowing out of the first open end 12A. The water entering the hollow railing 12 will thus be forced to flow out the second open end 12B of the hollow railing 12. The circulating water through the hollow railing 12 will control the temperature of the railing to that of the circulating water. In the preferred embodiment of the present invention, the gasket 34 is made out of rubber.

A fastener 36 is coupled to the bolt 26. The fastener 36 is used for applying and relieving pressure to the gasket 34 in order to cause the gasket 34 to expand/contract. By tightening or loosening the fastener 36, the gasket 34 will expand or contract in order to conform to the size of the first open end 12A of the hollow railing 12. When the fastener 36 is tightened, the gasket 34 will be squeezed in between the first washer 30 and the second washer 34. This will cause the gasket 34 to expand in an outward manner. The fastener 36 should be tightened until the gasket 34 reaches the interior wall of the hollow railing 12. When the fastener 36 is fully tightened, a water tight seal will be formed at the first end 12A of the hollow railing 12. In the preferred embodiment of the present invention, the fastener 36 is a wing nut which is threadedly coupled to the bolt 26.

The bolt 26 may further have a connector 38 coupled to a bottom end of the bolt 26. The connector 38 is used for coupling the conduit 14 to the plug 24. In the preferred embodiment of the present invention, the connector 38 will allow for a liquid tight seal to form between the conduit 14 and the plug 24 when the two are fastened together.

Figure 5:
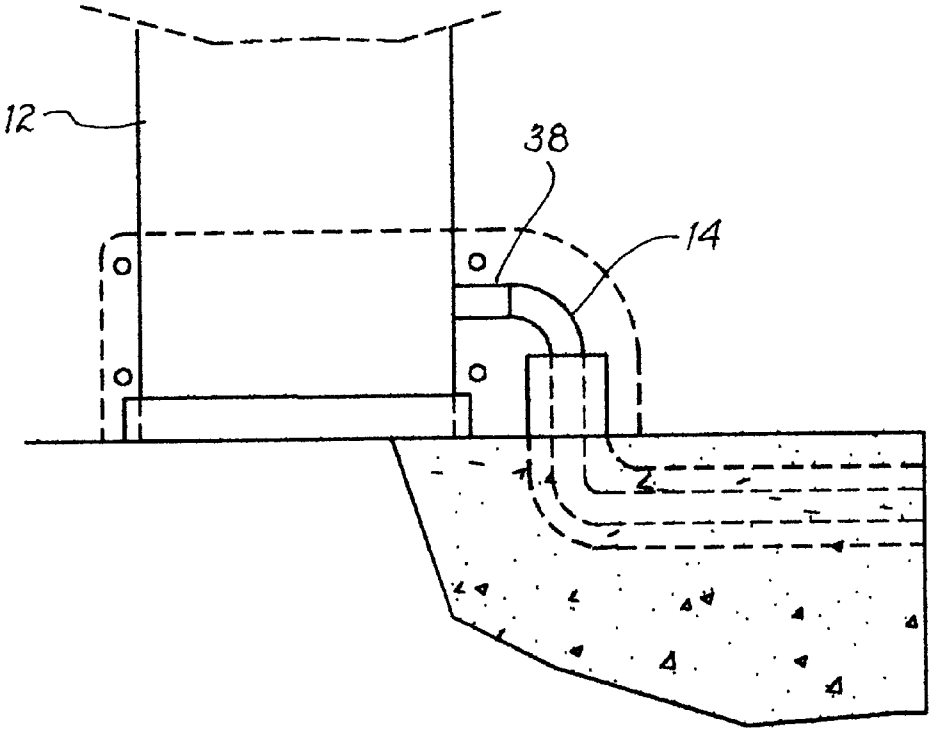
FIG. 5 is a front view of the system depicted in FIG. 1 being installed in a railing for an existing pool/spa.
Figure 4:
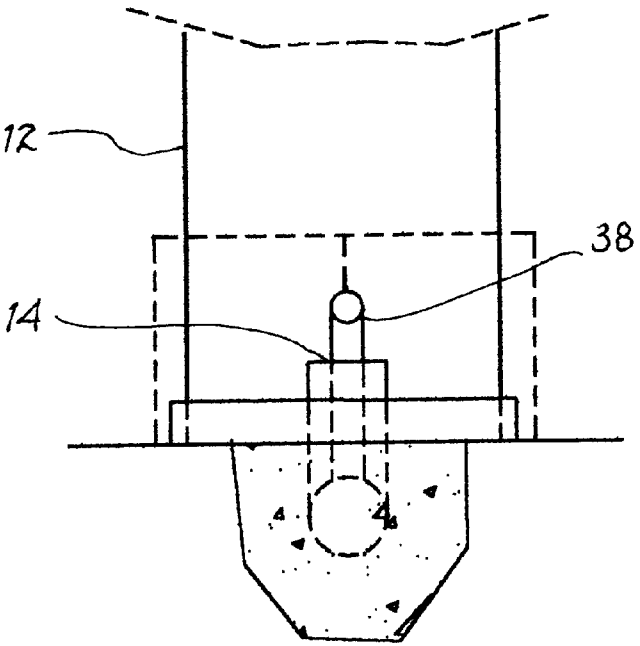
FIG. 4 is a front view of the system depicted in FIG. 1 being installed in a railing for a new pool/spa.

Referring now to FIGS. 4 and 5, two different drawings are shown to show the installation of the plug 26 in a new railing installation (FIG. 4) or an existing railing installation (FIG. 5). As may be seen in FIG. 5, in order to avoid the digging up of the existing railing 12, the connector 38 of the plug 26 may be in the form of an "L" connector. Thus a hole would be drilled through the side of the railing in order to connect the conduit 14 to the plug 26.

While the invention has been particularly shown and described with reference to preferred embodiments thereof, it will be understood by those skilled in the art that the foregoing and other changes in form and details may be made therein without departing from the spirit and scope of the invention. For example, the system may be installed on an outdoor stairway railing. Instead of a pool/spa, a water container is used to hold a supply of water. The water is drawn into the railing through the conduit by means of the pump. The water that exits the stairway railing is then sent back to the water container through an additional conduit.

What is claimed is:

1. A system for controlling a temperature of a railing comprising, in combination:

a hollow railing having a first open end and a second open end;

a conduit coupled to said first open end of said hollow railing for conveying a liquid to said hollow railing, said liquid traveling through and being used to control said temperature of said hollow railing; and a plug coupled to said first open end of said hollow railing for forming a liquid tight seal at said first open end of said hollow tubing for preventing said liquid from flowing out of said first open end and forcing said liquid to flow out said second open end of said hollow railing and for coupling said conduit to said hollow railing to allow said liquid to flow from said conduit through said hollow railing.

2. A system for controlling a temperature of a railing in accordance with claim 1 further comprising a pump coupled to said conduit for moving said liquid through said conduit and hollow railing.

3. A system for controlling a temperature of a railing in accordance with claim 2 further comprising a power supply coupled to said pump for supplying power to activate said pump.

4. A system for controlling a temperature of a railing in accordance with claim 2 further comprising a switch coupled to said power supply and to said pump for connecting and disconnecting said power supply to said pump.

5. A system for controlling a temperature of a railing in accordance with claim 2 further comprising a timer coupled to said pump for activating and deactivating said pump at predetermined times.

6. A system for controlling a temperature of a railing in accordance with claim 1 wherein said plug comprises:

a first washer;

a bolt placed through a center opening in said first washer and having a hollow channeling drill through a length of said bolt to allow said liquid to flow through said bolt;

a second washer having a center opening wherein said bolt is placed through said center opening of said second washer;

a rubber gasket position in between said first washer and said second washer for forming said liquid tight seal at said first open end of said hollow tubing; and a nut coupled to said bolt for applying and relieving pressure to said rubber gasket in order to expand and contract said rubber gasket to allow said rubber gasket conform to a size of said first open end of said hollow railing.

7. A system for controlling a temperature of a railing in accordance with claim 6 wherein said plug further comprises a connector coupled to a bottom end of said bolt for coupling said conduit to said plug and to form a liquid tight seal between said conduit and said plug.

8. A system for controlling a temperature of a railing comprising, in combination:

a hollow railing having a first open end and a second open end;

a conduit coupled to said first open end of said hollow railing for conveying a liquid to said hollow railing, said liquid traveling through and being used to control said temperature of said hollow railing;

a plug coupled to said first open end of said hollow railing for forming a liquid tight seal at said first open end of said hollow tubing for preventing said liquid from flowing out of said first open end and forcing said liquid to flow out said second open end of said hollow railing and for coupling said conduit to said hollow railing to allow said liquid to flow from said conduit through said hollow railing, said plug comprising:

a first washer;

a bolt placed through a center opening in said first washer and having a hollow channeling drill through a length of said bolt for allowing said liquid to flow through said bolt;

a second washer having a center opening wherein said bolt is placed through said center opening of said second washer;

a rubber gasket position in between said first washer and said second washer for forming said liquid tight seal at said first open end of said hollow tubing;

a nut coupled to said bolt for applying and relieving pressure to said rubber gasket in order to expand and contract said rubber gasket to allow said rubber gasket to conform to a size of said first open end of said hollow railing; and a connector coupled to a bottom end of said bolt for coupling said a conduit to said plug and to form a liquid tight seal between said conduit and said plug;

a pump coupled to said conduit for moving said liquid through said conduit and hollow railing; and a power supply coupled to said pump for supplying power to activate said pump.

9. A system for controlling a temperature of a railing in accordance with claim 8 further comprising a switch coupled to said power supply and to said pump for connecting and disconnecting said power supply to said pump.

10. A system for controlling a temperature of a railing in accordance with claim 8 further comprising a timer coupled to said pump for activating and deactivating said pump at predetermined times.

* * * * *